US007316850B2

(12) United States Patent
Hu et al.

(10) Patent No.: US 7,316,850 B2
(45) Date of Patent: Jan. 8, 2008

(54) MODIFIED MCRALY COATINGS ON TURBINE BLADE TIPS WITH IMPROVED DURABILITY

(75) Inventors: Yiping Hu, Greer, SC (US); William F. Hehmann, Greer, SC (US)

(73) Assignee: Honeywell International Inc., Morristown, NJ (US)

( * ) Notice: Subject to any disclaimer, the term of this patent is extended or adjusted under 35 U.S.C. 154(b) by 312 days.

(21) Appl. No.: 10/792,003

(22) Filed: Mar. 2, 2004

(65) Prior Publication Data

US 2007/0264523 A1 Nov. 15, 2007

(51) Int. Cl.
*B32B 15/04* (2006.01)
*F03B 3/12* (2006.01)
*C23C 14/14* (2006.01)

(52) U.S. Cl. ..... 428/637; 428/636; 428/676; 428/926; 427/405; 427/597; 420/437; 420/440; 420/444; 420/445; 420/456; 420/460; 420/588; 416/241 R

(58) Field of Classification Search ..... 428/678, 428/636, 637, 926, 934; 148/425, 428; 420/437, 420/440, 444, 445, 456, 460, 588; 416/241; 427/596, 597, 405
See application file for complete search history.

(56) References Cited

U.S. PATENT DOCUMENTS 4,152,488 A * 5/1979 Schilke et al. ..... 428/678
4,326,011 A 4/1982 Goebel et al.
4,419,416 A 12/1983 Gupta et al.
4,675,204 A 6/1987 Nicoll et al.
4,808,055 A 2/1989 Wertz et al.
4,937,042 A 6/1990 Perkins et al.
5,076,897 A 12/1991 Wride et al.
5,141,821 A * 8/1992 Lugscheider et al. ..... 428/614
5,232,789 A * 8/1993 Platz et al. ..... 428/637
5,374,319 A 12/1994 Stueber et al.
5,395,584 A 3/1995 Berger et al.
5,455,119 A * 10/1995 Taylor et al. ..... 420/437
5,554,837 A * 9/1996 Goodwater et al. .... 219/121.63
5,622,638 A 4/1997 Schell et al.
5,701,669 A 12/1997 Meier
5,942,337 A * 8/1999 Rickerby et al. ..... 428/623

(Continued)

FOREIGN PATENT DOCUMENTS

EP 0266299 A2 5/1988

(Continued)

OTHER PUBLICATIONS

PCT International Search Report PCT/US2005/006833, filed Apr. 3, 2006.

*Primary Examiner*—John J. Zimmerman
*Assistant Examiner*—Aaron Austin
(74) *Attorney, Agent, or Firm*—Ingrassia Fisher & Lorenz

(57) ABSTRACT

There is provided a method for depositing a modified MCrAlY coating on a turbine blade tip. The method utilizes laser deposition techniques to provide a metallurgical bond between a turbine blade substrate, such as a superalloy substrate, and the modified MCrAlY composition. Further the modified MCrAlY coating has sufficient thickness such that a post-welding grinding operation to size the turbine blade to a desired dimension will not remove the modified MCrAlY coating entirely. The modified MCrAlY coating thus remains on the finished turbine blade tip after grinding.

16 Claims, 4 Drawing Sheets

U.S. PATENT DOCUMENTS

| | | | | |
|---|---|---|---|---|
| 5,997,248 | A | 12/1999 | Ghasripoor et al. | |
| 6,149,389 | A | 11/2000 | Hennies et al. | |
| 6,221,175 | B1 | 4/2001 | Kurz et al. | |
| 6,264,039 | B1 * | 7/2001 | Chyi | 209/18 |
| 6,410,159 | B1 | 6/2002 | Hermanek | |
| 6,444,259 | B1 * | 9/2002 | Subramanian et al. | 427/191 |
| 6,475,642 | B1 * | 11/2002 | Zhao et al. | 428/636 |
| 7,009,137 | B2 * | 3/2006 | Guo | 219/121.64 |
| 2001/0004474 | A1 | 6/2001 | Allen et al. | |
| 2002/0068008 | A1 | 6/2002 | Shipton et al. | |

FOREIGN PATENT DOCUMENTS

| | | | | |
|---|---|---|---|---|
| EP | 1295969 | A1 | | 3/2003 |
| JP | 06220603 | A | * | 8/1994 |
| WO | WO 2004/016819 | A1 | | 2/2004 |
| WO | WO 2004016819 | A1 | * | 2/2004 |

* cited by examiner

MODIFIED MCRALY COATINGS ON TURBINE BLADE TIPS WITH IMPROVED DURABILITY

FIELD OF THE INVENTION

The present invention relates to a modified MCrAlY coating. More particularly the present invention relates to the use of a modified MCrAlY coating as applied onto HPT turbine blade tips for providing improved turbine blade durability.

BACKGROUND OF THE INVENTION

In an attempt to increase the efficiencies and performance of contemporary gas turbine engines generally, engineers have progressively pushed the engine environment to more extreme operating conditions. The harsh operating conditions of high temperature and pressure that are now frequently specified place increased demands on engine component-manufacturing technologies and new materials. Indeed the gradual improvement in engine design has come about in part due to the increased strength and durability of new materials that can withstand the operating conditions present in the modern gas turbine engine. With these changes in engine materials there has arisen a corresponding need to develop new repair and coating methods appropriate for such materials.

The turbine blade is one engine component that directly experiences severe engine conditions. Turbine blades are thus designed and manufactured to perform under repeated cycles of high stress and high temperature. An economic consequence of such a design criteria is that currently used turbine blades can be quite expensive. It is thus highly desirable to maintain turbine blades in service for as long as possible, and to return worn turbine blades to service, if possible, through acceptable repair procedures.

Turbine blades used in modern gas turbine engines are frequently castings from a class of materials known as superalloys. The superalloys include nickel-, cobalt- and iron-based alloys. In the cast form, turbine blades made from superalloys include many desirable elevated-temperature properties such as high strength and good environment resistance. Advantageously, the strength displayed by this material remains present even under stressful conditions, such as high temperature and high pressure, that are experienced during engine operation.

The superalloys are thus a preferred material for the construction of turbine blades and vanes. The high-strength superalloys are noted as precipitation hardening alloys. Nickel, alloyed with other element such as aluminum and titanium, develops high strength characteristics that are sustainable at high temperatures, the temperature range that engine designers now seek. The strength arises in part through the presence of a gamma prime (γ') phase of material. One characteristic of the superalloys is the high degree of gamma prime in cast materials.

While the superalloys exhibit superior mechanical properties under high temperature and pressure conditions, they are subject to attack by chemical degradation. The gases at high temperature and pressure in the turbine engine can lead to hot corrosion and oxidation of the exposed superalloy substrates in turbine blades. Those turbine blades at the high pressure stages following the combustion stage of a gas turbine engine are particularly subject to this kind of erosion, and the portion of a turbine blade at the blade tip is even more subject to corrosion and oxidation as this area of the blade also experiences high pressure and temperature. Blade tips are also potential wear points. Corrosion and oxidation are both undesirable in that these processes can lead to the gradual erosion of blade tip material, which affects the dimensional characteristic of the blade as well as physical integrity. In order to protect superalloy turbine blades, a coating may be placed on both the airfoil surfaces, and the blade tip, to act as a barrier between the engine environment and the substrate material.

Among other materials, conventional MCrAlY coatings have been used as one kind of coating on turbine blades to resist corrosion and oxidation. In the conventional formulation of MCrAlY, M represents one of the metals Ni, Co, or Fe or alloys thereof. Cr, Al, and Y are the chemical symbols for Chromium, Aluminum, and Yttrium. Some conventional MCrAlY formulations are discussed in the following U.S. patents: U.S. Pat. Nos. 4,532,191; 4,246,323; and 3,676,085. Families of MCrAlY compositions are built around the Nickel, Cobalt, or Iron constituents. Thus the literature speaks of NiCrAlY, NiCoCrAlY, CoCrAlY, CoNiCrAlY, and so on.

The efficiency of gas turbine engines also depends in part on the ability to minimize the leakage of compressed air between the turbine blades and the shroud of the engine's turbine section. In order to minimize the gap between the turbine blade tips and the shroud, turbine blades often undergo a final rotor grinding before engine assembly. This grinding attempts to closely match the turbine blade size to the shroud diameter. However this machining process can result in the removal of the thin MCrAlY or other overlay coating (Pt-aliminide) on the turbine blade tip. When this occurs the bare blade alloy is directly exposed to the severe conditions of the engine environment. This exposure opens the blade to corrosion and/or oxidation that causes blade tip recession or failure. These are factors that potentially result in performance losses due to higher leakage of compressed air between the blade tips and the inner shroud. Further the corrosion and oxidation ultimately leads to erosion or wearing out of the turbine blade tips.

In conventional methods, MCrAlY is applied to a turbine blade as a coating layer through a thermal spray coating process like low pressure plasma spray (LPPS) or electron beam physical vapor deposition (EBPVD). In the thermal spray coating process the MCrAlY coating adheres to the surface of the substrate through mechanical bonding. The MCrAlY coating adheres to asperities previously fashioned onto the substrate surface. This process does not result in a metallurgical or chemical attachment of the MCrAlY material to the underlying substrate. This is described in U.S. Pat. No. 6,410,159.

Additionally, conventional methods of applying MCrAlY coatings have deposited a relatively thin MCrAlY layer, such 5-50 μm, as described in U.S. Pat. No. 6,149,389. Such a thin layer makes it possible for the grinding step to grind off the coating if, for example, the amount of grinding exceeds the depth of the coating in any particular area.

The option of throwing out worn turbine blades and replacing them with new ones is not an attractive alternative. The high pressure turbine (HPT) blades are expensive. A turbine blade made of superalloy can be quite costly to replace, and a single stage in a gas turbine engine may contain several dozen such blades. Moreover, a typical gas turbine engine can have multiple rows or stages of turbine blades. Consequently there is a strong financial need to find an acceptable repair or coating method for superalloy turbine blades.

Hence, there is a need for a turbine repair and coating method that addresses one or more of the above-noted drawbacks. Namely, a repair and coating method is needed that provides a strong bond between an MCrAlY protective layer and the turbine substrate, and/or a method that allows the deposit of MCrAlY onto a superalloy substrate such that sufficient MCrAlY layer still remains on the blade tip after subsequent grinding process and/or a modified MCrAlY composition that provides improved properties and durability, and/or a method that by virtue of the foregoing is therefore less costly as compared to the alternative of replacing worn turbine parts with new ones. The present invention addresses one or more of these needs.

SUMMARY OF THE INVENTION

The present invention provides a modified MCrAlY composition, hereinafter designated as modified MCrAlY or MCrAlYX, and a method for using the same as a turbine blade coating. The modified MCrAlY material is suitable for deposition onto a superalloy substrate through laser deposition welding, which results in a metallurgical bonding with the base alloy. Moreover, the laser deposition of the modified MCrAlY achieves a coating thickness such that post-welding grinding of the turbine blade does not remove the MCrAlYX coating. The MCrAlYX coating achieves excellent bonding to the superalloy substrate, including single crystal superalloys, and thus provides improved performance due to enhancing corrosion and oxidation resistance.

In one exemplary embodiment, and by way of example only, there is provided a nickel based alloy for use as a coating comprising: a composition represented by the formula MCrAlYX wherein M comprises at least one member of the group consisting of Ni, Co and Fe; X comprises at least one member of the group consisting of Pt, Hf, Si, Zr, Ta, Re, and Ru; and wherein the weight percentage of X to the total composition is within the range of about 0.1% to about 28.0%. For cost purposes Pt may be excluded from some formulations. In a further embodiment the weight percentage of X to the total composition is within the range of about 0.5% to about 15.0%. In a further embodiment the weight percentage of X to the total composition is within the range of about 1.0% to about 7.0%. In a further embodiment M comprises at least one member of the group consisting of Ni and Co or, alternatively Ni/Co alloy.

In a further embodiment, and by way of example only there is provided a method for applying a coating to a turbine blade surface comprising: providing to the turbine blade surface a powder alloy represented by the formula MCrAlYX wherein M wherein comprises at least one member of the group consisting of Ni, Co, and Fe; wherein X comprises at least one member of the group consisting of Pt, Hf, Si, Zr, Ta, Re, and Ru; and wherein the weight percentage of X to the total composition is within the range of about 0.1% to about 28.0%; and bonding the powder alloy to a turbine blade surface as a coating through laser powder fusion welding.

In still a further embodiment, and by way of example only, there is provided a coated turbine blade comprising: an airfoil having a convex face and a concave face; a base assembly attached to said airfoil; a tip at the outer radial end of the airfoil; and a coated region on the tip wherein the coated region comprises MCrAlYX. The MCrAlYX coating may have a thickness of up to approximately 0.050 inch, or more preferably up to approximately 0.020 inch. The coating has a thickness up to 0.020 inch after post-welding grinding. The coating provides resistance to oxidation and corrosion, and the airfoil may be comprised of a superalloy.

Other independent features and advantages of the modified MCrAlY coating on turbine blade tips will become apparent from the following detailed description, taken in conjunction with the accompanying drawings which illustrate, by way of example, the principles of the invention.

DETAILED DESCRIPTION OF A PREFERRED EMBODIMENT

Reference will now be made in detail to exemplary embodiments of the invention, examples of which are illustrated in the accompanying drawings. Wherever possible, the same reference numbers will be used throughout the drawings to refer to the same or like parts.

Figure 1:
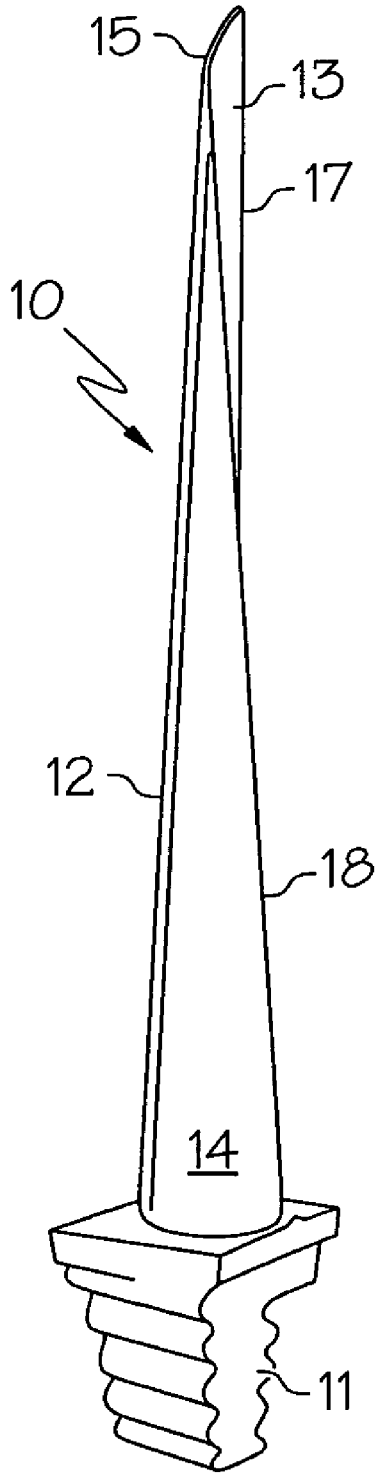
FIG. 1. is a perspective view of a turbine blade such as may be processed in accordance with an embodiment of the invention.

A typical gas turbine blade 10 is illustrated in FIG. 1. In general, turbine blade geometry and dimension have been designed differently, depending on turbine engine model and its application. For aero engines, such a blade is typically several inches in length. A turbine blade includes a serrated base assembly 11, also called a mounting dovetail, tang, or Christmas tree. Airfoil 12, a cuplike structure, includes a concave face 13 and a convex face 14. In the literature of turbine technology airfoil 12 may also be referred to as a bucket. Turbine blade 10 also includes leading edge 17 and trailing edge 18 which represent the edges of airfoil 12 that firstly and lastly encounter an air stream passing around airfoil 12. Turbine blade 10 also include tip 15. Tip 15 may include raised features known as "squealers" (not shown) in the industry. Turbine blade 10 is often composed of a highly durable material such as a superalloy. It is also desirable to cast turbine blades in a single crystal superalloy in order to maximize elevated-temperature properties and dimensional stability.

Figure 2:
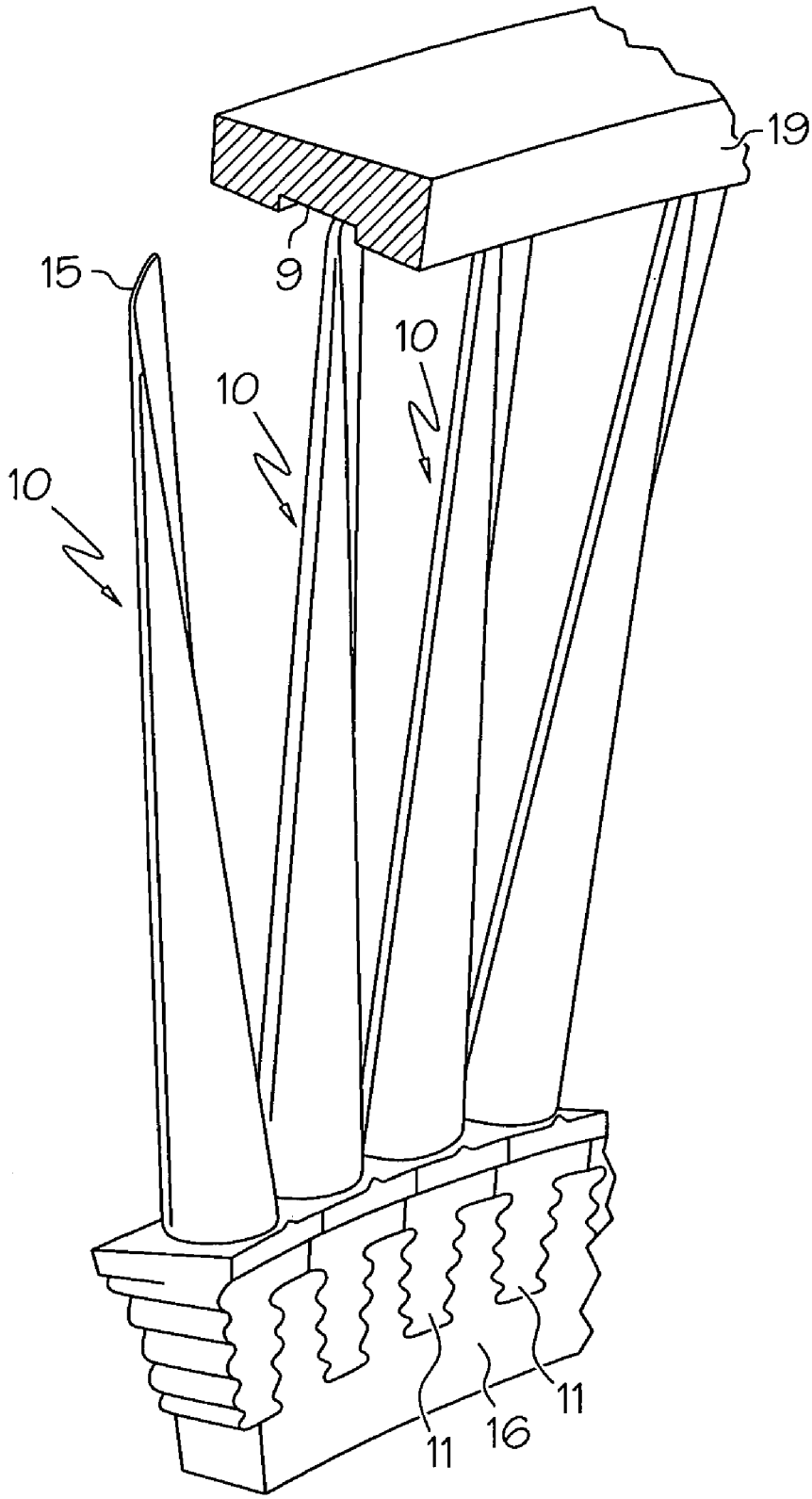
FIG. 2 is a perspective view of a part of a turbine rotor assembly including turbine blades as may be processed according to an embodiment of the invention.

Referring now to FIG. 2 turbine blade 10 is affixed to a hub 16 at base assembly 11. Airfoil 12 extends radially outwardly from hub 16 toward shroud 19. In a jet engine assembly multiple such turbine blades are positioned in adjacent circumferential position along hub 16. Many gas turbine engines have a shroud structure 19. Shroud 19 surrounds a row of turbine blades at the upper (outer radial) end of turbine blade 10. Further shroud 19 includes groove 9. Turbine blades 10 are disposed so that tip 15 is within the area defined by groove 9. In operation, gases impinge on concave face 13 of airfoil 12 thereby providing the driving force for the turbine engine. Further the close fit of blade tip 15 within groove 9 minimizes the escape of gases around the turbine stage, thus increasing engine efficiency.

The proximity of blade tip 15 and groove 9 provide a potential contact point for wear to occur. Further, the passage of hot gases through the gap between tip 15 and groove 9 leads to high temperature and pressure conditions at tip 15. Thus blade tips 15 may be coated with a hardened or protective layer to resist mechanical wear as well as corrosion and oxidation. Conventional MCrAlY is one such coating practiced with turbine blades particularly at tip 15.

It has now been discovered that a modified MCrAlY, different from convention formulations, offers improved performance characteristics. The modified MCrAlY formulation includes the addition of other elements. Thus, the modified composition is represented by the designation MCrAlYX where X represents the additional constituent not present in conventional formulations.

In a preferred embodiment MCrAlYX represents the formula of the coating material. M is preferably selected from Ni, Co and NiCo alloys. X represents one or more of the following elements: Pt (Platinum), Hf (Hafnium), Si (Silicon), Zr (Zirconium), Ta (Tantalum), Re (Rhenium), and Ru (Ruthenium). Further X may represent combinations of the designated elements. The composition may also include incidental impurities resulting from typical manufacturing processes such as Carbon and Boron. In a preferred embodiment two, three, or four components selected from the group represented by X are included in the modified formulation.

In one embodiment, the MCrAlYX composition includes the following ranges for percentage by weight of each constituent.

| Element | Range Weight % |
|---|---|
| Co | about 15-about 22 |
| Cr | about 15-about 25 |
| Al | about 8-about 15 |
| Y | about 0.1-about 1.0 |
| Pt | about 20-about 35 |
| Hf | about 1.0-about 5.0 |
| Si | about 1.0-about 5.0 |
| Zr | about 1.0-about 3.0 |
| Ta | about 1.0-about 5.0 |
| Re | about 1.0-about 5.0 |
| Ru | about 1.0-about 5.0 |
| Ni | Remainder. |

In a further preferred embodiment, the MCrAlYX composition described above excludes Platinum. Platinum is an expensive constituent, and it is desirable to provide a formulation that achieves a comparable performance without the use of expensive elements. This second preferred embodiment thus includes the following ranges for percentage by weight of each constituent.

| Element | Range Weight % |
|---|---|
| Co | about 15-about 22 |
| Cr | about 15-about 25 |
| Al | about 8-about 15 |
| Y | about 0.1-about 1.0 |
| Hf | about 1.0-about 5.0 |
| Si | about 1.0-about 5.0 |
| Zr | about 1.0-about3.0 |
| Ta | about 1.0-about 5.0 |
| Re | about 1.0-about 5.0 |
| Ru | about 1.0-about 5.0 |
| Ni | Remainder. |

In a further preferred embodiment the MCrAlYX composition includes fewer than all the elements represented by X. In this formulation the weight percentages of those elements can go to zero. Thus this embodiment has the following ranges for percentage by weight of each constituent.

| Element | Range Weight % |
|---|---|
| Co | about 15-about 22 |
| Cr | about 15-about 25 |
| Al | about 8-about 15 |
| Y | about 0.1-about 1.0 |
| Hf | 0-about 5.0 |
| Si | 0-about 5.0 |
| Zr | 0-about 3.0 |
| Ta | 0-about 5.0 |
| Re | 0-about 5.0 |
| Ru | 0-about 5.0 |
| Ni | Remainder. |

In a further preferred composition, the MCrAlYX includes one or more of the elements represented by X. Other embodiments include two or more, three or more, and four or more of the elements represented by X. In the further preferred embodiments of the MCrAlYX composition with less than all the elements represented by X included in the composition, the weight percentage of X in the total composition may fall between about 0 and about 28 percent. Alternatively, the weight percentage of X in the total formulation may fall between about 0.5 and about 15 percent. Alternatively and preferably, the weight percentage of X in the total formulation may fall between about 1.0 and about 7.0 percent.

A preferred specific formulation of the MCrAlYX composition is as follows:

| Element | Weight % |
|---|---|
| Co | about 20 |
| Cr | about 25 |
| Al | about 13 |
| Y | about 0.3 |
| Hf | about 2.0 |
| Si | about 0.65 |
| Re | about 3.0 |
| Ni | Remainder. |

A further preferred specific formulation of the MCrAlYX composition is as follows:

| Element | Weight % |
|---|---|
| Co | about 20 |
| Cr | about 22 |
| Al | about 13 |
| Y | about 0.3 |
| Hf | about 2.0 |
| Si | about 0.65 |
| Re | about 3.0 |
| Ru | about 1.5 |
| Ni | Remainder. |

An additional preferred specific formulation of the MCrAlYX composition is as follows:

| Element | Weight % |
|---|---|
| Co | about 20 |
| Cr | about 25 |
| Al | about 13 |
| Y | about 0.4 |
| Hf | about 2.0 |
| Si | about 0.80 |
| Ni | Remainder. |

The MCrAlYX composition is intended for use as a coating on a turbine blade. As such it is particularly adapted for use with turbine blades made of advanced superalloys. Thus some specific turbine substrates for which the composition is adapted for use include the following superalloys: IN-738, IN-792, MarM 247, C 101, Rene 80, Rene 125, Rene 142, GTD 111, Rene N5, CMSX 4, SC 180, PWA 1480, and PWA 1484.

The MCrAlYX composition described herein can be manufactured as a powder for use in laser cladding operations. The alloy material may be put in powderized form by conventional powder processing methods, such as inert gas atomization from ingots. A preferred mesh size for the powder is between +325 and −120.

The MCrAlYX compositions described above demonstrate improved performance with respect to oxidation resistance and corrosion resistance. Turbine blade tips coated with such materials are better able to withstand the corrosive and oxidative forces encountered in a gas turbine engine.

Figure 3:
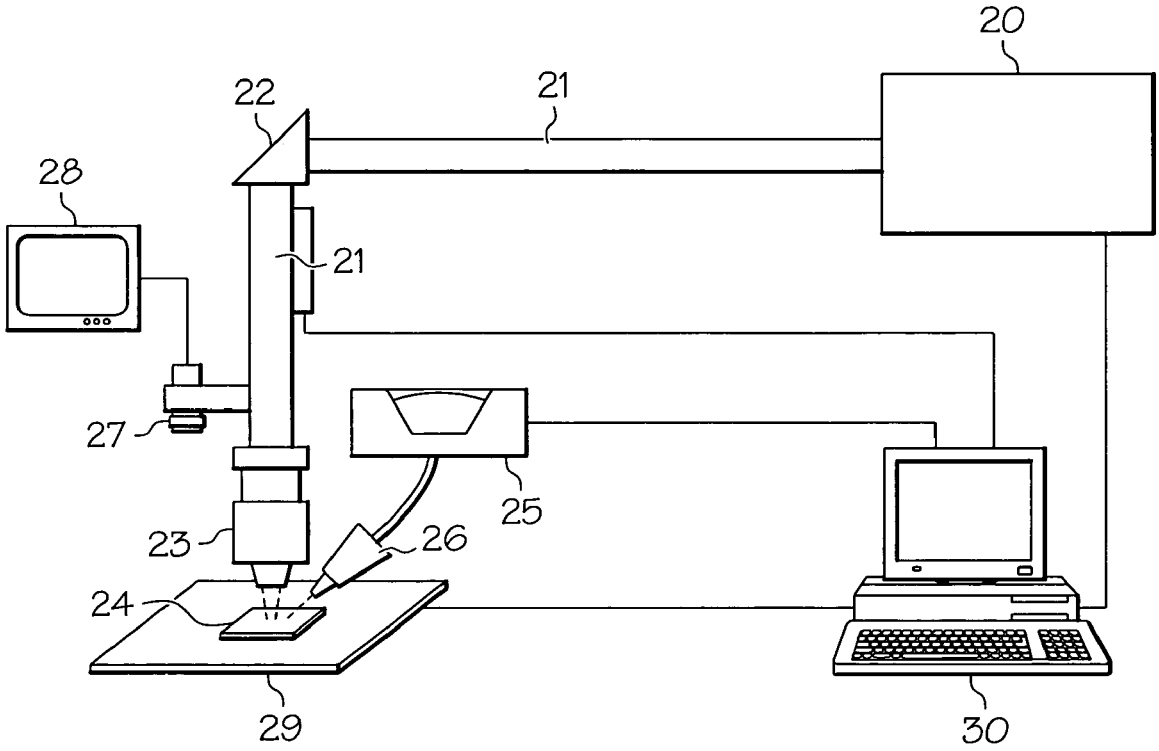
FIG. 3 is a schematic representation of the equipment and apparatus that may be used to perform laser deposition welding in accordance with an embodiment of the invention.

In a preferred method, the MCrAlYX composition is deposited on a turbine blade as a coating through a laser cladding or welding process. Referring now to FIG. 3 there is shown a schematic diagram of a general apparatus for laser generation and control that may be used in the multiple laser welding system according to an embodiment of this invention. Laser generating means 20 generates a laser used in the welding system. A laser is directed through typical laser powder fusion welding equipment which may include beam guide 21, mirror 22, and focus lens 23. The laser then impinges on a surface of the workpiece 24. Components such as beam guide 21, mirror 22, and focus lens 23 are items known in the art of laser welding. Beamguide 21 may include fiber optic materials such as optic fiber laser transmission lines. Furthermore, with certain laser types a laser may be directed onto workpiece 24 through an optic fiber line.

A means for providing a filler or cladding material is also included for use with the main laser, the laser effecting the cladding operation. Preferably this filler material may be provided in powder feeder 25. In such an embodiment the powder is fed onto the workpiece through powder feed nozzle 26. A coaxial or off-axis arrangement may be used with powder feed nozzle 26 with respect to the main laser. Alternatively, filler material may be provided through other means such as a wire feed.

Other components of the system include vision camera 27 and video monitor 28. The image taken by the camera can also be fedback to the controller screen for positioning and welding programming. The workpiece 24 is held on a work table 29. An inert gas shield (not shown) is fed through guides (not shown) onto the workpiece 24. The inert gas shield is directed onto a portion of the surface of the workpiece 24 during laser welding.

Controller 30 may be a computer numerically controlled (CNC) positioning system. CNC controller 30 coordinates components of the system. As is known in the art the controller may also include a digital imaging system. The controller guides movement of the laser and powder feed across the face of the workpiece 24. In a preferred embodiment, movement of the workpiece in the XY plane is achieved through movement of the worktable 29. Movement in the up and down, or Z-direction is achieved by control of the laser arm; i.e., pulling it up or lowering it. Alternative methods of control are possible, such as controlled movement of the workpiece in all three directions, X, Y, and Z as well as rotation and tilt.

In a preferred embodiment, the power of the laser is between about 50 to about 2500 watts and more preferably between about 50 to about 1500 watts. The powder feed rate of powder filler material is between about 1.5 to about 20 grams per minute and more preferably about 1.5 to about 10 grams per minute. Traveling speed for relative motion of the substrate positioning table 29 relative to the laser beam is about 5 to about 22 inches per minute and more preferably about 5 to about 14 inches per minute. The size of the main spot cast by the laser onto the work surface is about 0.02 to about 0.1 inches in diameter and more preferably about 0.04 to about 0.06 inches. The laser-welded bead width that results through the laser is thus about 0.02 to about 0.100 inches and more preferably about 0.04 to about 0.06 inches in width.

The laser used in the laser cladding apparatus may be a YAG, $CO_2$, fiber, or direct diode laser. One laser embodiment that has been found to operate in the present welding method is known as a direct diode laser. A direct diode laser provides a compact size, good energy absorptivity, and a reasonably large beam spot size. Laser Diodes, sometimes called injection lasers, are similar to light-emitting diodes [LEDs]. In forward bias [+ on p-side], electrons are injected across the P—N junction into the semiconductor to create light. These photons are emitted in all directions from the plane on the P-N junction. To achieve lasing, mirrors for feedback and a waveguide to confine the light distribution are provided. The light emitted from them is asymmetric. The beam shape of the HPDDL system are rectangular or a line source. This beam profile does not have a "key-hole", thus yielding a high quality welding process. Due to their high efficiency, these HPDDL are very compact and can be mounted directly on a tube mill or robot enabling high speed and high quality welding of both ferrous and nonferrous metals.

Additionally a YAG laser may also be used in an embodiment of the present invention. The YAG laser refers to an Yttrium Aluminum Garnet laser. Such lasers also may include a doping material, such as Neodymium (Nd), and such a laser is sometimes referred to as an Nd:YAG laser. The present invention may also be practiced with YAG lasers that use other dopant materials. In a preferred embodiment, the YAG laser of the present invention is a model 408-1 YAG laser manufactured by US Laser that is commercially available. When operated in continuous wave (CW) mode the laser provides sufficient heat at a specific spot to effect laser welding.

Having described the MCrAlYX composition and laser cladding apparatus from a structural standpoint, a method of using such an assembly in a welding operation with MCrAlYX will now be described.

Figure 4:
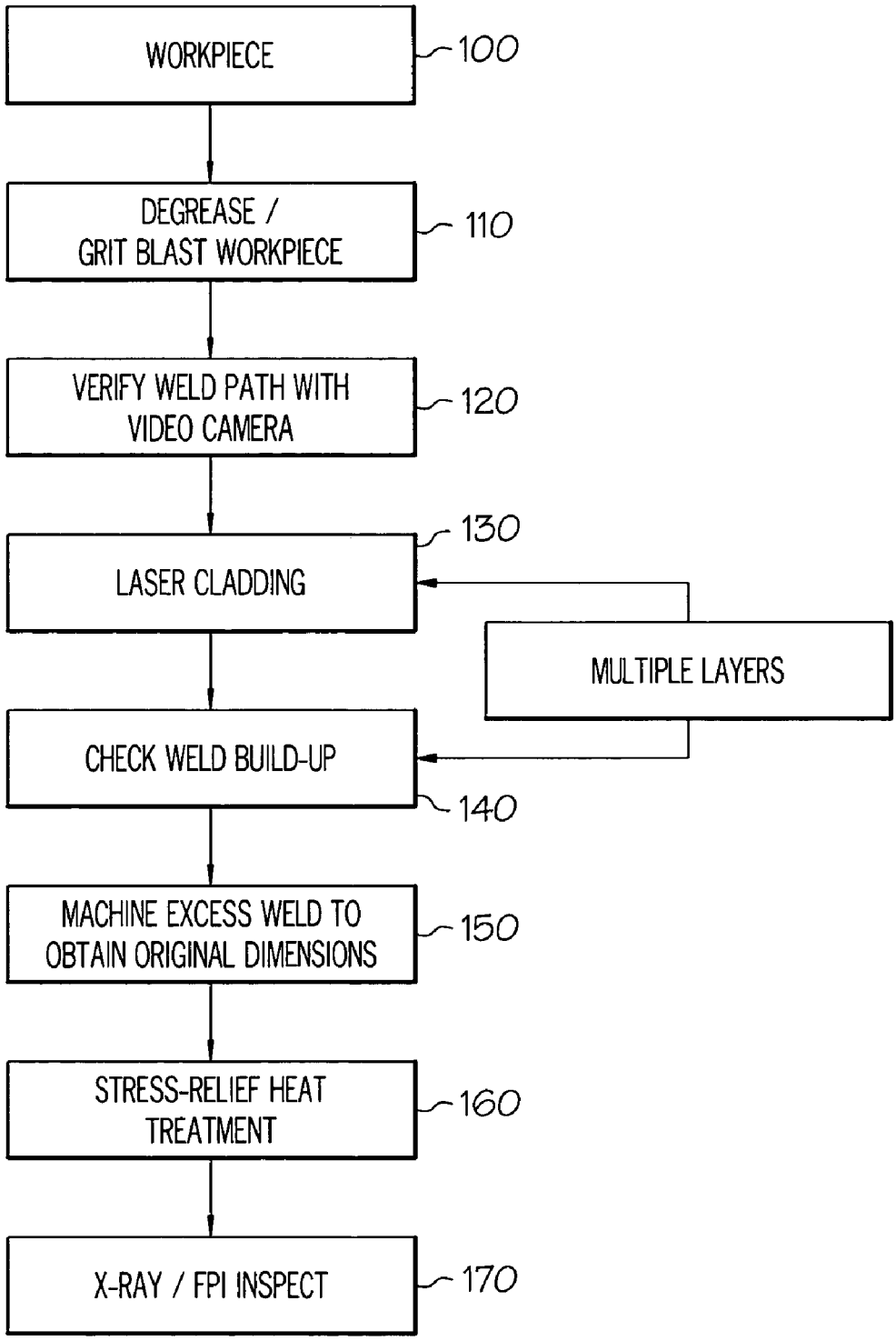
FIG. 4 is an exemplary functional schematic block diagram of a laser powder fusion welding process using the MCrAlYX composition as a coating on an HPT turbine blade.

Referring now to FIG. 4, there is shown a functional block diagram of the steps in one embodiment of the laser welding process. A suitable workpiece is first identified in step 100.

Inspection of the workpiece confirms that the workpiece is a suitable candidate for operation by a laser welding process. The workpiece should not suffer from mechanical defects or other damage that would disqualify it from return to service, other than wear, which can be repaired by the welding method. Step 110 reflects that the workpiece may be subjected to a pre-welding treatment to prepare the piece for welding. In a preferred embodiment the piece receives a pre-welding machining and degreasing in order to remove materials that interfere with laser welding such as corrosion, impurity buildups, and contamination on the face of the workpiece. In addition the piece may receive a grit blasting with an abrasive such as aluminum oxide in order to enhance the absorptivity of laser beam energy.

Next, in step 120 a digital monitoring system such as used by a CNC controller may be used to identify a weld path on the workpiece. Using digital imaging through a video camera, the CNC controller records surface and dimensional data from the workpiece. Other welding parameters such as weld path geometry, distances, velocities, powder feed rates, and power outputs are entered. In addition a stitch path to cover a desired area of the turbine blade may be selected.

After these preparatory steps, laser welding deposition commences in step 130. A first deposition pass takes place. Then a series of material deposition steps are repeated, if necessary, through repetitions of steps 130 and 140. In the first pass, the laser welding process deposits a layer of MCrAlYX on the turbine blade tip. The thickness of such a deposit is between about 20 to about 30 thousandths of an inch. Upon conclusion of a first welding pass, the CNC controller will check the thickness of the weld deposit, step 140. If the build-up of material is below that desired, a second welding pass occurs. While a single welding pass may not be sufficient to deposit the desired thickness of material, it is also the case that multiple passes may be needed to achieve the desired dimension of newly deposited material. In this manner a series of welding passes can build up a desired thickness of newly deposited MCrAlYX. When the digital viewer determines that the thickness of material has reached the desired limit, welding ceases.

In step 150 the turbine blade is machined to return the blade to a desired configuration or dimension. The deposition of the MCrAlYX coating may result in an uneven surface. Machining restores an even surface to a desired dimension. Similarly it may be desirable to overdeposit material in order to assure that sufficient coating layer remains on the surface. Known machining techniques can then remove excess weld material.

After machining the MCrAlYX coating thickness on the turbine blade is in the range of about 0.005 to about 0.050 inches. More preferably the coating thickness is between about 0.005 and about 0.020 inches after machining.

Post welding steps may also include procedures such as a heat treatment to achieve stress relief, step 160. An FPI (Fluorescent Penetration Inspection) inspection of a turbine blade, as well as an x-ray inspection, step 170, may follow. At this time the turbine blade may be returned to service, or placed in service for the first time.

A particular embodiment of the method to deposit the MCrAlYX composition is described as follows. As abovementioned it is often the case that several deposition layers are required in order to build up an overall desired coating thickness of the MCrAlYX material. While MCrAlYX compositions which include Pt are desirable, it becomes expensive to deposit an entire coating, with multiple layers, made of a Pt-including MCrAlYX composition. It has thus been discovered that improved corrosion and oxidation resistance can be achieved where only certain deposition layers comprise the Pt-including MCrAlYX composition and the remaining deposition layers comprise the MCrAlYX composition without Pt, that is Pt-free MCrAlYX. Thus, for example, in a three layer deposition, the first layer may be composed of a Pt-free MCrAlYX, the second layer a Pt-including MCrAlYX, and the third layer a Pt-free MCrAlYX. Various combinations are thus possible, so long as some layers of the overall coating include Pt and others do not.

It has been pointed out that the post-welding grinding operation can result in the physical removal of portions of a turbine blade coating. It is therefore desirable that the outermost MCrAlYX layers of a multi-layer coating not include expensive constituents such as Pt as it is these outermost layers that are likely to be removed by grinding. Conversely, it is desirable that the innermost MCrAlYX layers of a multi-layer coating, the first layer deposited onto the turbine blade substrate and those immediately above the substrate, be the layers that include expensive constituents such as Pt. It is these innermost layers which are unlikely to be physically removed by grinding.

Thus, in a further exemplary embodiment of a multi-layer MCrAlYX coating there is provided: a first layer of MCrAlYX deposited directly onto the superalloy blade tip substrate which includes Pt, a second layer above the first layer of Pt-free MCrAlYX, and a third layer above the second layer of Pt-free MCrAlYX.

A primary advantage of the disclosed MCrAlYX composition is improved performance with respect to oxidation and corrosion resistance.

A further advantage of the MCrAlYX composition and method for depositing the composition is the ability to deposit a sufficiently thick coating such that it will not be entirely removed by a post-welding grinding operation.

Still a further advantage of the MCrAlYX composition and method for depositing the composition is the metallurgical bond that results between the MCrAlYX composition and the underlying substrate material. And as a result of these advantages the need to replace expensive superalloy turbine blades is minimized.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A coating for a superalloy substrate, the coating comprising:

a first coating layer formed over the substrate and comprising an alloy represented by the formula MCrAlYX wherein M comprises at least one member of the group consisting of Ni, Co, and Fe, and X comprises Pt and at least one member of the group consisting of Hf, Si, Zr, Ta, Re, and Ru, the weight percentage of X to the total composition being within the range of about 0.1% to about 28.0; and at least one additional coating layer on either side of the first coating layer, wherein the at least one additional coating layer includes a modified MCrAlY alloy that does not include Pt.

2. The coating according to claim 1 wherein the weight percentage of X to the total composition is within the range of about 0.5% to about 15.0%.

3. The coating according to claim 1 wherein the weight percentage of X to the total composition is within the range of about 1.0% to about 7.0%.

4. The coating according to claim 1 wherein M comprises at least one member of the group consisting of Ni and Co.

5. The coating according to claim 1 wherein M comprises Ni/Co alloy.

6. The coating according to claim 1 wherein M comprises Ni.

7. A nickel based powder composition for use in depositing a coating on a superalloy substrate, the nickel based powder composition having the following ingredients and weight percentages:

| Element | Range Weight % |
|---|---|
| Co | about 15-about 22 |
| Cr | about 15-about 25 |
| Al | about 8-about 15 |
| Y | about 0.1-about 1.0 |
| Pt | about 20-about 35 |
| Hf | about 1.0-about 5.0 |
| Si | about 1.0-about 5.0 |
| Zr | 0-about 3.0 |
| Ta | 0-about 5.0 |
| Re | about 1.0-about 5.0 |
| Ru | about 1.0-about 5.0 |
| Ni | remainder. |

8. A nickel based powder composition for use in depositing a coating on a superalloy substrate, the nickel based powder composition having the following ingredients and weight percentages:

| Element | Range Weight % |
|---|---|
| Co | about 15-about 22 |
| Cr | about 15-about 25 |
| Al | about 8-about 15 |
| Y | about 0.1-about 1.0 |
| Hf | about 1.0-about 5.0 |
| Si | about 1.0-about 5.0 |
| Zr | about 1.0-about 3.0 |
| Ta | about 1.0-about 5.0 |
| Re | about 1.0-about 5.0 |
| Ru | about 1.0-about 5.0 |
| Ni | remainder. |

9. A method for preparing a coated high pressure turbine blade for assembly in a gas turbine engine comprising the steps of:

providing a suitable turbine blade having a tip to be coated;

grit blasting the turbine blade;

verifying a laser weld path on the turbine blade tip with a video camera;

providing at the turbine blade tip a powder alloy represented by the formula MCrAlYX wherein M wherein comprises at least one member of the group consisting of Fe, Ni, and Co; and wherein X comprises at least one member of the group consisting of Pt, Hf, Si, Zr, Ta, Re, and Ru; and wherein the weight percentage of X to the total composition is within the range of about 0.1% to about 28.0%;

laser welding the powder alloy to the turbine blade tip in a layer checking the depth of the welded layer;

repeating the steps of laser welding and checking the depth until a desired coating thickness is achieved;

grinding the turbine blade tip; and inspecting the turbine blade through FPI inspection or X-Ray inspection.

10. A coated turbine blade comprising:

an airfoil having a convex face and a concave face;

a base assembly attached to said airfoil;

a tip at the outer radial end of the airfoil; and a coated region on the tip wherein the coated region comprises:

a first coating layer formed over the substrate and comprising an alloy represented by the formula MCrAlYX, wherein M comprises at least one member of the group consisting of Ni, Co, and Fe, X comprises a combination of at least Pt, Hf and Si, and the weight percentage of X to the total composition is within the range of about 0.1% to about 28.0%, and at least one additional coating layer on either side of the first coating layer, wherein the at least one additional coating layer includes a modified MCrAlY alloy that does not include Pt.

11. The turbine blade according to claim 10 wherein said MCrAlYX coating has a thickness of up to approximately 0.050 inch.

12. The turbine blade according to claim 10 wherein said MCrAlYX coating has a thickness of up to approximately 0.020 inch.

13. The turbine blade according to claim 10 wherein said coating has a thickness of up to approximately 0.020 inch after post-welding grinding.

14. The turbine blade according to claim 10 wherein said coating provides resistance to oxidation and corrosion.

15. The turbine blade according to claim 10 wherein said airfoil further comprises a superalloy.

16. The turbine blade according to claim 10 wherein X further comprises at least one element from the group consisting of Zr and Ta.

* * * * *